US009027349B2

(12) United States Patent
Miura et al.

(10) Patent No.: US 9,027,349 B2
(45) Date of Patent: May 12, 2015

(54) GAS TURBINE GASEOUS FUEL INJECTION SYSTEM

(75) Inventors: Keisuke Miura, Mito (JP); Tomomi Koganezawa, Tokai (JP); Satoshi Dodo, Kasama (JP); Takeo Saito, Hitachinaka (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 642 days.

(21) Appl. No.: 13/358,227

(22) Filed: Jan. 25, 2012

(65) Prior Publication Data

US 2012/0192568 A1 Aug. 2, 2012

(30) Foreign Application Priority Data

Jan. 27, 2011 (JP) ..... 2011-014682

(51) Int. Cl.
*F02C 1/00* (2006.01)
*F23R 3/28* (2006.01)

(52) U.S. Cl.
CPC ..... *F23R 3/286* (2013.01)

(58) Field of Classification Search
CPC ..... F23R 3/26; F23R 3/14; F23R 3/10; F23R 3/04; F23R 3/16; F23R 3/28; F23R 3/286
USPC ..... 60/737, 740, 742, 748, 746
See application file for complete search history.

(56) References Cited

U.S. PATENT DOCUMENTS

| | | | | |
|---|---|---|---|---|
| 5,097,666 | A * | 3/1992 | Shekleton et al. | 60/737 |
| 7,426,833 | B2 * | 9/2008 | Yoshida et al. | 60/737 |
| 8,127,549 | B2 * | 3/2012 | Miura et al. | 60/737 |
| 2002/0078690 | A1 * | 6/2002 | Stuttaford et al. | 60/737 |
| 2004/0000146 | A1 * | 1/2004 | Inoue et al. | 60/776 |
| 2004/0011054 | A1 | 1/2004 | Inoue et al. | |
| 2004/0255589 | A1 * | 12/2004 | Yoshida et al. | 60/746 |
| 2009/0173075 | A1 * | 7/2009 | Miura et al. | 60/737 |
| 2010/0064694 | A1 | 3/2010 | Dodo et al. | |
| 2011/0016866 | A1 * | 1/2011 | Boardman et al. | 60/730 |
| 2011/0076628 | A1 | 3/2011 | Miura et al. | |

FOREIGN PATENT DOCUMENTS

| | | | |
|---|---|---|---|
| JP | 8-296852 | A | 11/1996 |
| JP | 2003-97291 | A | 4/2003 |
| JP | 2003-148734 | A | 5/2003 |
| JP | 2010-65963 | A | 3/2010 |
| JP | 2010-133621 | A | 6/2010 |
| JP | 2011-75172 | A | 4/2011 |

OTHER PUBLICATIONS

Japanese Office Action with English translation dated Nov. 5, 2013 (5 pages).

* cited by examiner

*Primary Examiner* — Gerald L Sung
(74) *Attorney, Agent, or Firm* — Crowell & Moring LLP

(57) ABSTRACT

A combustor of the prior art that defines the outlet position and direction of an air hole and suppresses adhesion of flame to an air hole outlet can reduce a discharge amount of NOx by increasing a distance over which fuel and air are mixed with each other. However, such a combustor is not sufficiently discussed for measures to suppress the occurrence of combustion oscillation resulting from the variation of a flame surface.

A combustor 2 according to the present invention includes a combustion chamber 5 to which fuel and air are supplied; air holes 32 adapted to supply air to the combustion chamber 5; fuel nozzles 25 adapted to supply gaseous fuel to the air holes 32; and orifices 24 adapted to allow the gaseous fuel supplied to the air holes 32 to cause a pressure drop.

6 Claims, 9 Drawing Sheets

GAS TURBINE GASEOUS FUEL INJECTION SYSTEM

BACKGROUND OF THE INVENTION

1. Field of the Invention

The present invention relates to a gas turbine combustor and an operating method therefor.

2. Description of the Related Art

Gas turbines need to further reduce NOx emissions from the standpoint of environmental protection.

Measures to be taken to reduce NOx emissions from a gas turbine combustor include the use of a premixed combustor. In this case, however, there is concern about occurrence of a flash-back phenomenon, i.e., a phenomenon of flame entering the inside of the premixed combustor.

JP-2003-148734-A discloses a combustor configured to include fuel nozzles adapted to supply fuel to a combustion chamber and air holes located on the downstream side of the fuel nozzles and adapted to supply air. In addition, a jet hole of the fuel nozzle and a corresponding air hole are disposed on the same axis. This combustor achieves a balance between anti-flash back performance and low-NOx combustion.

JP-2010-133621-A discloses means for defining the outlet position and direction of an air hole and preventing flame from adhering to the outlet of the air hole. Unlike the disclosure of JP-2003-148734-A, a discharge amount of NOx can further be reduced by increasing a distance over which fuel and air are mixed with each other.

SUMMARY OF THE INVENTION

In JP-2010-133621-A, measures are not sufficiently discussed which are taken to suppress the occurrence of combustion oscillation resulting from the variation of a flame surface.

It is an object of the present invention to provide a gas turbine combustor that can suppress combustion oscillation resulting from the variation of a flame surface.

According to an aspect of the present invention, there is provided a gas turbine combustor including a combustion chamber to which fuel and air are supplied; an air hole adapted to supply air to the combustion chamber; a fuel nozzle adapted to supply gaseous fuel to the air hole; and an orifice adapted to allow the gaseous fuel supplied to the air hole to cause a pressure drop.

The present invention can provide the gas turbine combustor that can suppress combustion oscillation resulting from the variation of a flame surface.

DESCRIPTION OF THE PREFERRED EMBODIMENTS

Preferred embodiments will hereinafter be described below.

First Embodiment

Figure 3:
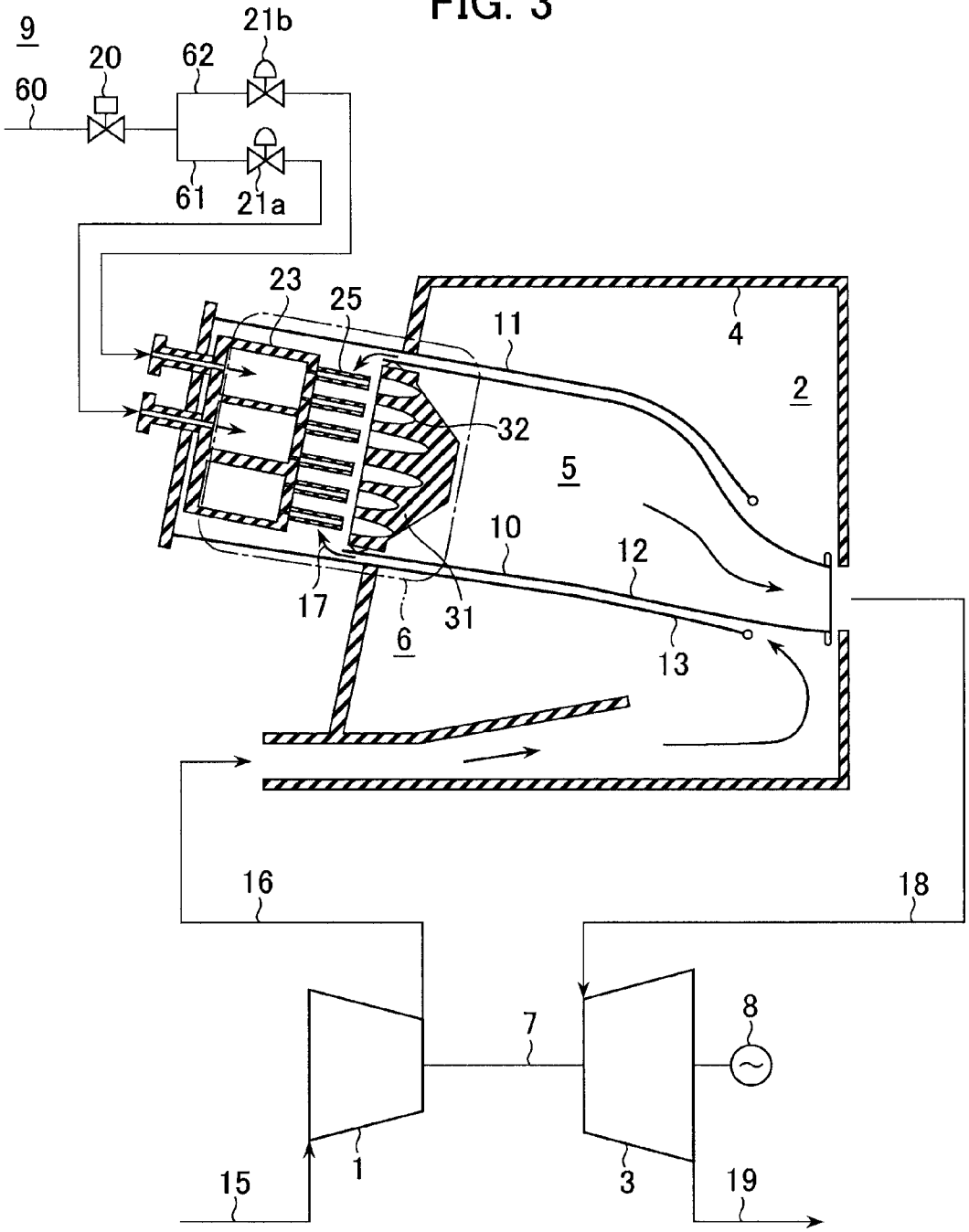
FIG. 3 is a plant system diagram illustrating a schematic configuration of a gas turbine plant to which the gas turbine combustor of the first embodiment is applied.

FIG. 3 is a system diagram illustrating an overall configuration of a gas turbine plant 9 for power generation.

Referring to FIG. 3, a gas turbine for power generation includes a compressor 1, a combustor 2, a turbine 3, a generator 8 and a shaft 7. The compressor 1 pressurizes suction air 15 to generate high-pressure air 16. The combustor 2 burns the high pressure air 16 generated by the compressor 1 and gaseous fuel from a fuel system 60 to generate high-temperature combustion gas 18. The turbine 3 is driven by the high-temperature combustion gas 18 generated by the combustor 2. The generator 8 is rotated by the drive of the turbine 3 to generate electric power. The shaft 7 integrally connects the compressor 1, the turbine 3 and the generator 8.

The combustor 2 is housed inside a casing 4.

The combustor 2 has a burner 6 located at its head portion. In addition, the combustor 2 has a substantially cylindrical combustor liner 10 located on the downstream side of the burner 6 inside the combustor 2. The combustor liner 10 is adapted to isolate the high-pressure air from the combustion gas.

A flow sleeve 11 is disposed on the outer circumference of the combustor liner 10 so as to serve as an outer circumferential wall defining an airflow path. The airflow path is adapted to permit the high-pressure air to flow downward. The flow sleeve 11 has a diameter greater than that of the combustor liner 10 and is disposed almost concentrically with the combustor liner 10.

A transition piece 12 is disposed on the downstream side of the combustor liner 10 so as to lead the high-temperature combustion gas 18 generated in a combustion chamber 5 of the combustor 2 to the turbine 3. A flow sleeve 13 is disposed on the outer circumferential side of the transition piece 12.

The suction air 15 is compressed by the compressor 1 to become the high-pressure air 16. The high-pressure air 16 is filled inside the casing 4 and then flows into the space between the transition piece 12 and the flow sleeve 13 to convection-cool the transition piece 12 from the outer wall surface.

Further, the high-pressure air 16 passes through an annular flow passage defined between the flow sleeve 11 and the combustor liner 10 and flows toward the head portion of the combustor 2. While flowing, the high-pressure air 16 is used to convection-cool the combustor liner 10.

The high-pressure air 16 partially flows into the inside of the combustor liner 10 from a number of cooling holes provided in the combustor liner 10 and is used for film-cooling the combustor liner 10.

The remainder of the high-pressure air 16 that has not been used for the film-cooling of the combustor liner 10, i.e., air 17 for combustion flows into the combustion chamber 5 from a number of air holes 32 provided in an air hole plate 31 located on the upstream side of the combustion chamber 5.

The air 17 for combustion flowing into the combustor liner 10 from the air holes 32 is burned in the combustion chamber 5 along with the fuel jetted from fuel nozzles 25 to generate the high-temperature combustion gas 18. This high-temperature combustion gas 18 is supplied to the turbine 3 via the transition piece 12.

The high-temperature combustion gas 18 having driven the turbine 3 is discharged and becomes exhaust gas 19.

The driving force obtained by the turbine 3 is transmitted to the compressor 1 and the generator 8 through the shaft 7.

A part of driving force obtained by the turbine 3 drives the compressor 1 to compress air 15 to generate the high-pressure air 16. Meanwhile, the other part of the driving force obtained by the turbine 3 rotates the generator 8 to generate electric power.

The burner 6 has two fuel systems: a fuel system 61 and a fuel system 62. These fuel systems 61 and 62 have respective fuel flow regulating valves 21. A flow rate of the fuel from the fuel system 61 is regulated by a fuel flow regulating valve 21*a* whereas a flow rate of the fuel from the fuel system 62 is regulated by a fuel flow regulating valve 21*b*. In this way, electricity to be generated by the gas turbine plant 9 is controlled. A fuel shutoff valve 20 for interrupting fuel to flow is installed to the upstream side of a bifurcation of the two fuel systems 61 and 62.

Figure 1:
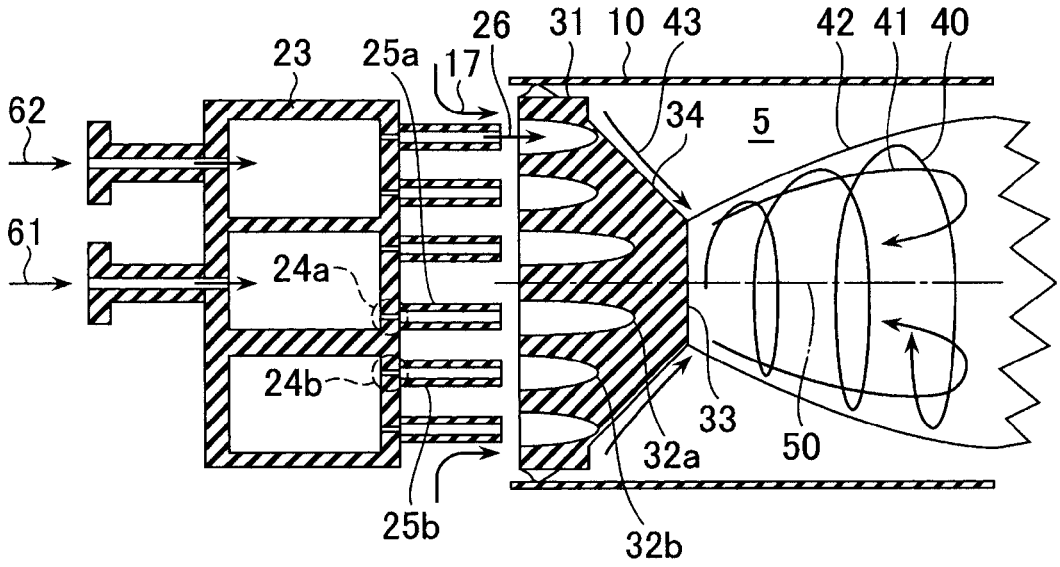
FIG. 1 is a partial-configurational view illustrating details of an arrangement state of a fuel nozzle header and fuel nozzles constituting a fuel supply section and an air hole plate in a gas turbine combustor according to a first embodiment.
Figure 2:
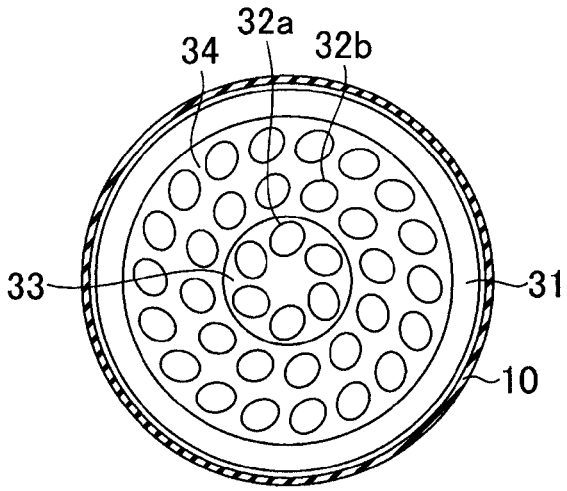
FIG. 2 is a front view of the air hole plate of the first embodiment shown in FIG. 1 as viewed from a combustion chamber side.

The details of the burner 6 are shown in a cross-sectional view of FIG. 1. The air hole plate 31 is shown in a front view of FIG. 2 as viewed from the combustion chamber 5. The details are hereinafter described with reference to FIGS. 1 and 2.

The burner 6 of the present embodiment is such that a number of the fuel nozzles 25 adapted to jet fuel are attached to a fuel header 23. A number of the air holes 32 installed in the air hole plate 31 are each arranged to face a corresponding one of the fuel nozzles 25. In other words, gaseous fuel from each of the fuel nozzles 25 is supplied to a corresponding one of the air holes 32. As shown in the front view of FIG. 2, the air holes 32 are arranged on three rows of concentric circles.

Figure 4A:
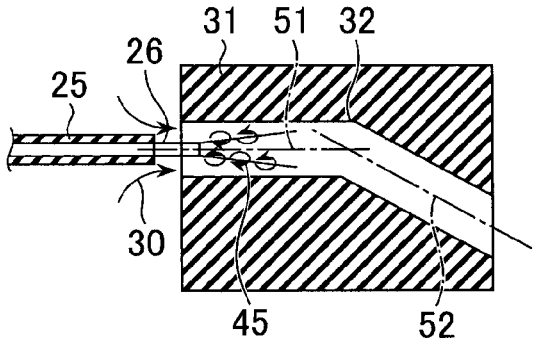
FIGS. 4A and 4B are detailed cross-sectional views illustrating the relationship between a pair of an air hole and a fuel nozzle.

FIG. 4A is a detailed view of the air hole 32 and the fuel nozzle 25. The air hole 32 of the present embodiment is bent at the middle of a flow path, i.e., has two central axes. An upstream side central axis 51 is parallel to a burner central axis 50 (i.e. the central axis of the air hole plate 31) shown in FIG. 1, whereas a downstream side central axis 52 has an angle relative to the burner central axis 50. Thus, a swirl flow 40 shown in FIG. 1 can be formed in the combustion chamber 5. In the inside of the air hole 32, an air flow 30 moves in such a manner as to surround the circumference of fuel jet 26. Swirls 45 occur at the boundary surface between the fuel jet 26 and the air flow 30 due to a velocity difference and a density difference, causing the flow turbulence. This flow turbulence transfers and stirs fuel and air in the radial direction for mixing them. With the configuration of the present embodiment, in the upstream side of the air hole 32, the fuel jet 26 flows along the center of the air flow 30, the flowing direction of the fuel jet 26 is the same as that of the air flow 30. Therefore, the fuel jet 26 will not flow eccentrically inside the air hole 32. Thus, fuel efficiently diffuses radially outwardly, which promotes the mixing of the fuel with air.

As described above, a number of the coaxial flows of the fuel jets 26 and the air flows 30 are formed to increase the interfaces between fuel and air. Fuel and air mix with each other at each coaxial flow. The mixture in which fuel and air are sufficiently mixed with each other is jetted from the outlets of the air holes 32 toward the combustion chamber 5. Therefore, flame temperature distribution of premixed flame 42 formed as shown in FIG. 1 is made uniform, which can reduce the amount of NOx generation.

Figure 4B:
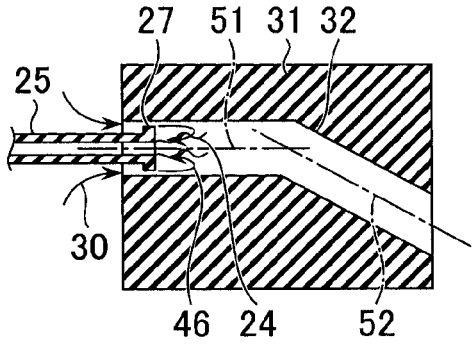

In the present embodiment, the fuel nozzle 25 is shaped as a circular cylinder to its leading end. However, in order to further promote the mixing of fuel with air, it is effective to provide a projection 27 at the leading end of the fuel nozzle 25 as shown in FIG. 4B. In addition, as shown in FIG. 4B, the leading end of the fuel nozzle 25 is inserted into the inside of the air hole 32, which further promotes the mixing of fuel with air. If the leading end of the fuel nozzle is inserted into the inside of the air hole 32, the air flow 30 moving around the leading end of the fuel nozzle 25 is increased in velocity. In addition to this, the projection 27 causes strong flow turbulence, which generates swirls 46. These swirls 46 transfer the fuel jet 26 and the air flow 30 in the radial direction and by strongly stirring, the fuel jet 26 and the air flow 30 can be positively mixed. Since the fuel and air is made uniform before reaching the premixed flame 42, it is possible to suppress the local temperature rise of the flame, which can further reduce the discharge amount of NOx. Also in the following embodiments, it is effective to provide the projection 27 at the leading end of the fuel nozzle 25 in order to reduce NOx.

As shown in FIG. 1, the air hole plate 31 of the present embodiment is such that the center of the burner 6 projects toward the combustion chamber 5 from the outer circumferential portion thereof. First-row air holes 32*a* have respective outlets arranged in a flat surface 33 of the burner leading end vertical to the burner central axis 50. On the other hand, second- and third-row air holes 32*b* have respective outlets arranged in an inclined plane 34 of the air hole plate 31. As described above, all the downstream side central axes 52 of the air holes 32 of the present embodiment are arranged inclinedly with respect to the direction of the burner central axis 50. In this way, the strong swirl flow 40 is formed in the combustion chamber 5 to cause a large recirculation flow 41. The recirculation flow 41 is formed at a position where a part of the air hole plate 31 projects into the combustion chamber 5. Entrainment due to the recirculation flow 41 causes a flow 43 moving toward the recirculation flow 41 at a position close to the inclined plane 34 of the air plate 31. This flow 43 prevents the high-temperature combustion gas located at the central portion from flowing toward the second- and third-row air holes 32*b*.

The high-temperature combustion gas is stably supplied by the recirculation flow 41 to the vicinity of the flat surface 33 of the burner leading end, which holds flame at the outlets of the first-row air holes 32*a*. On the other hand, heat is not supplied to the vicinity of the second- and third-row air holes 32*b*. A flow resulting from the entrainment eliminates a stagnation region, so that flame is not held. Thus, conical flame 42 as shown in the figure is formed. The second- and third-row conical jet nozzles mix fuel with air more due to the abrupt expansion at the outlet of the air hole 32*b* and to a long distance in which the flame 42 is reached from the outlet of the air hole 32*b*. Thus, the discharge amount of NOx discharged from the combustor 2 can be reduced significantly.

In the present embodiment, the distance is increased in which the mixed gas of fuel and air reaches the frame 42 from the outlets of the second- and third-row air holes 32*b*. In this case, the outer circumferential portion of the flame 42 becomes easy to vary in the burner-axial direction and this variation is likely to develop into combustion oscillation.

Figure 5:
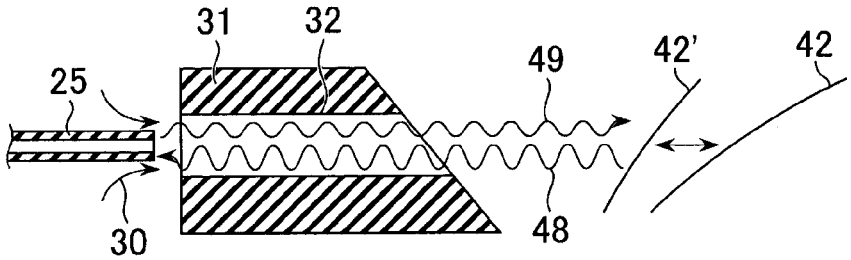
FIG. 5 is a schematic view representing the relationship among the air hole, the fuel nozzle and flame.

A combustion oscillation-generating mechanism is described with reference to FIG. 5. A flame surface of the flame 42 is formed at a position where the flow velocity of an unburned mixture balances with the propagating speed of the flame. However, a swirl flow 40 is formed by a number of jets in the combustion chamber 5; therefore, a very turbulent turbulence-field is formed in the combustion chamber 5, in which the flame surface varies. In the present embodiment, the conical flame 42 is formed in order to reduce the discharge amount of NOx; therefore, the flame 42 are likely to largely vary in the burner-axial direction, such as shift to a position 42' after a short period of time. The flame 42 varies in the axial direction to cause a pressure variation, which propagates toward the upstream side. Such behavior is shown with arrow 48. A fuel flow rate is varied by the differential pressure between the front and rear of a fuel nozzle; therefore, the fuel flow rate is varied by the pressure variation due to the variation of the flame surface. The variation of the fuel flow rate varies the fuel-air ratio of the mixture passing through the air hole 32. Such behavior is shown with arrow 49. The variation in the fuel-air ratio of the mixture varies the combustion velocity of the flame 42. The position where the flow velocity of the unburned mixture balances with the propagating speed of the flame is varied to further vary the position of the flame surface. Thus, a feedback loop is formed to cause combustion oscillation.

To suppress the occurrence of the combustion oscillation, the fuel nozzle 25 of the present embodiment has a portion that abruptly narrows and then abruptly expands a flow path through which fuel passes. This portion is called an orifice 24 in the present embodiment. The orifice 24 in the present embodiment allows the gaseous fuel supplied to the air hole 32 to cause a pressure drop inside the fuel nozzle 25. Each of second- and third-row fuel nozzles 25*b* influenced by the flame surface variation has an orifice 24*b* with a small diameter. Such an orifice 24*b* provides sufficiently large differential pressure for the pressure variation resulting from the flame surface variation. In this way, a variation value relative to the average value of the differential pressures between the front and rear of the fuel nozzles is relatively reduced and consequently the flow rate variation of fuel can be reduced. Thus, the occurrence of the combustion oscillation can be suppressed.

Incidentally, the combustor for a gas turbine has to stably hold flame under wide conditions from start-up to a 100%-load. In particular, under a part-load condition a supply fuel flow rate is low and the overall fuel-air ratio is low. If fuel is supplied to all the fuel nozzles, fuel becomes lean, so that flame becomes unstable. Thus, a large amount of unburned fuel is likely to occur. To prevent this, a method is widely employed in which a diffusion burner is arranged at the center of the burner to form diffusion flame for stable combustion under the part-load condition. However, this method discharges a large amount of NOx under the 100%-load condition.

Figure 6:
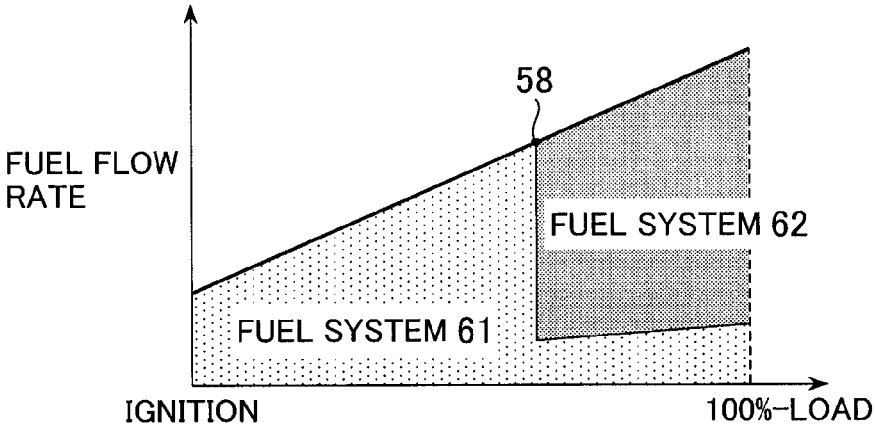
FIG. 6 illustrates one example of the operation of the combustor from ignition to a 100%-load condition in the first embodiment.

The mode of the present embodiment to deal with this disadvantage is described with reference to FIG. 6. FIG. 6 illustrates one example of the operation of the combustor 2 from ignition to a 100%-load condition in the present embodiment. The combustor 2 is operated by only the fuel supplied from the fuel system 61 under the operation from the ignition to the part-load condition 58. When the part-load condition 58 is reached, the fuel supplied from the fuel system 61 is reduced and fuel supplied from the fuel system 62 is added according to the reduced fuel.

In the present embodiment, fuel is supplied from the fuel system 61 only to first-row fuel nozzles 25*a* under the part-load condition as shown in FIG. 6. Since the fuel flow rate supplied for each nozzle is increased, the fuel jet 26 passes through the air flow 30 and spurts into the combustion chamber 5 while remaining non-mixed. Then, while the fuel jet 26 mixes with air jetted from the second- and third-row air holes 32*b* in the combustion chamber 5, diffusion flame can be formed.

Under the part-load condition 58 in which the largest amount of fuel flows into the fuel nozzle 25*a*, it is necessary to suppress differential pressure so as to make it possible to allow the fuel to flow into the fuel nozzles 25*a* at a given flow rate. In the present embodiment, therefore, the diameter (an opening area) of each of orifices 24*a* arranged at the first row is made greater than that (an opening area) of each of the orifices 24*b* arranged at the second and third rows. Thus, the differential pressure between the front and rear of the orifice 24*a* is reduced.

If the diameter of the orifice 24*a* is increased, there is concern that the variation of flame may cause combustion oscillation. However, flame is held at the outlets of the air holes 32*a* on the first row in which the orifices 24*a* are arranged, so that the flame surface does not vary. Thus, even if the increased diameter of the orifice 24*a* reduces the differential pressure between the front and rear of the orifice 24*a*, there is no concern about the occurrence of combustion oscillation.

In the present embodiment, the outlets of the air holes 32*a* for stabilizing flame are limited to a narrow area. In this case, the pressure difference at the outlet of the fuel nozzle 25*a* is limited to a further small level. Therefore, the variation or deviation of the fuel flow rate is hard to occur. Thus, it is not necessary to install an orifice for cost reduction at a fuel nozzle 25*a* corresponding to an air hole 32*a* that holds flame at an outlet. Also in this case, there is no concern about the occurrence of combustion oscillation.

In the present embodiment, the fuel supply system is divided into the two fuel supply systems: the fuel supply system 61 adapted to supply fuel to the fuel nozzles 25*a* paired with the corresponding air holes 32*a* holding flame at the air hole outlets; and the fuel supply system 62 adapted to supply fuel to the fuel nozzles 25*b* paired with the corresponding air holes 32*b* not holding flame at the air hole outlets. The diameter of each of the orifices 24*b* installed at the fuel nozzles 25*b* is made smaller than that of each of the orifices 24*a* installed at the fuel nozzles 25*a*. In this way, suppression of the occurrence of combustion oscillation and the occurrence of unburned fuel even under the part-load condition is operated.

Figure 7A:
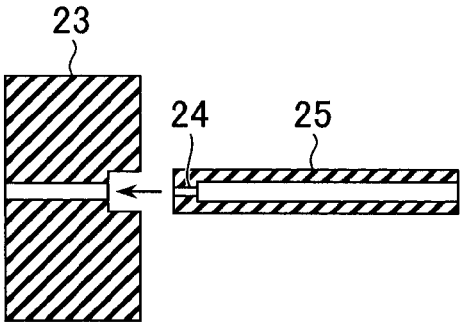
FIGS. 7A and 7B illustrate one example of an orifice installation method according to the first embodiment.
Figure 7B:
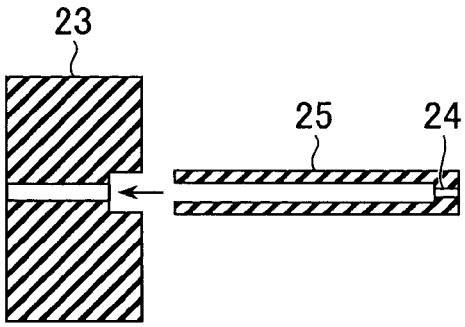
Figure 8:
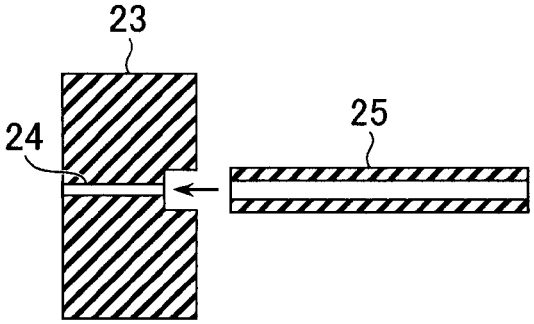
FIG. 8 illustrates another example of an orifice installation method according to the first embodiment.
Figure 9:
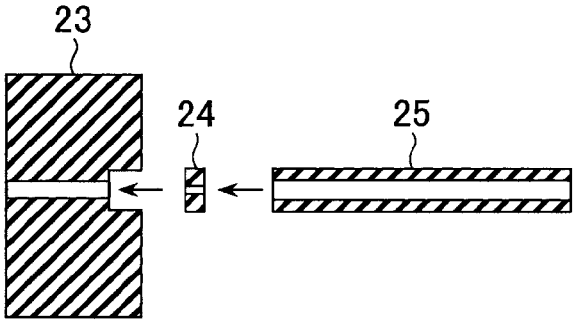
FIG. 9 illustrates yet another example of an orifice installation method according to the first embodiment.

A description is next given of a orifice installation method. In the present embodiment, a plurality of the fuel nozzles 25 are attached to the fuel header 23. As shown in FIGS. 7A and 7B, the orifice installation method involves manufacturing an orifice 24 integrally with a fuel nozzle 25 and attaching the integral piece to the fuel header 23. As shown in FIG. 7A, the orifice 24 is located at the root of the fuel nozzle 25. Alternatively, as shown in FIG. 7B, the orifice 24 may be located at the leading end of the fuel nozzle. The present method is effective for the case where fuel and air are not mixed because the jet velocity of fuel is increased. As shown in FIG. 8, another method may involve providing a small-diameter path in the fuel header 23 at a position of upstream side of a fuel nozzle installation position and using it as an orifice 24. As shown in FIG. 9, another method may involve manufacturing an orifice 24 as a member separate from a fuel nozzle 25 and from a fuel header 23 and joining them together by welding or press fitting.

Figure 10:
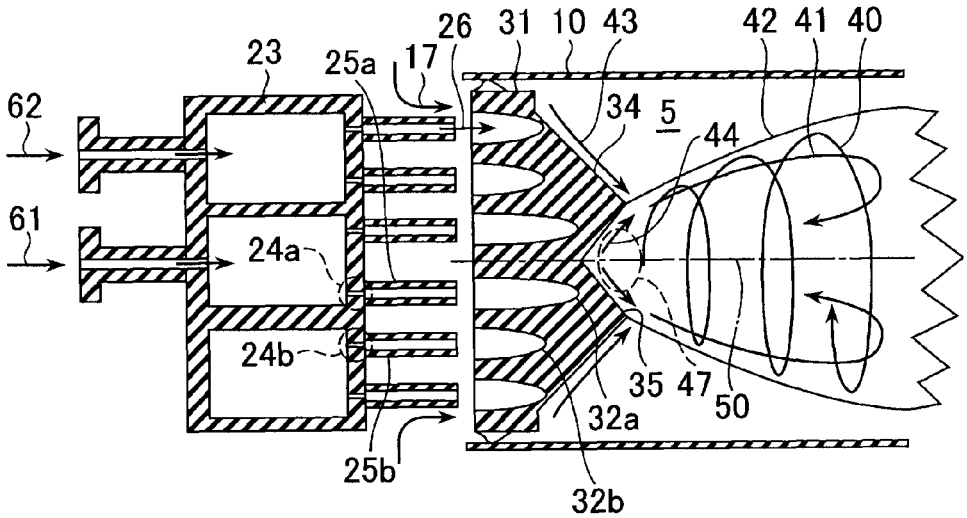
FIG. 10 is a partial configurational view illustrating the details of an arrangement state of a fuel nozzle header and fuel nozzles constituting a fuel supply section and an air hole plate in a gas turbine combustor according to a variation of the first embodiment.
Figure 11:
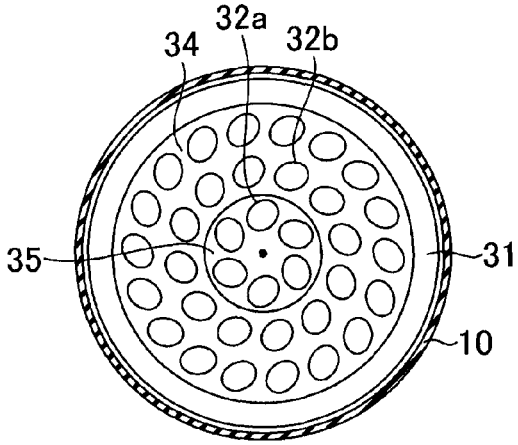
FIG. 11 is a front view of the air hole plate of the variation of the first embodiment shown in FIG. 10 as viewed from the combustion chamber side.

FIG. 10 is a cross-sectional view illustrating a variation of the present embodiment, reinforcing the stability of flame. FIG. 11 is a front view of FIG. 10. In the embodiment having been described thus far, the outlets of the first-row air holes 32*a* are arranged in the flat surface 33 located at the leading end of the burner 6 vertical to the burner central axis 50. In this variation, similarly, the burner partially projects toward the combustion chamber 5, but, the burner central portion is recessed with respect to the combustion chamber 5. The outlets of the first-row air holes 32*a* are arranged in an inclined plane 35.

In such a configuration, a flow 44 moving toward the outer circumferential portion from the burner center is generated. The combustion gas is supplied to the outlets of the first-row air holes 32*a* by the recirculation flow 41, so that flame is held at the outlets of the first-row air holes 32*a*. An area 47 close to the outlets of the first-row air holes 32*a* is surrounded at its circumference by the inclined plane 35 of the air hole plate 31. In this area 47, a flow is stabilized without undergoing disturbance from the circumference thereof. Thus, since a flame-holding point undergoes no disturbance, well-stabilized flame can be formed.

Similarly to the first embodiment, a flow 43 moving toward the burner center from the outer circumferential portion occurs in the vicinity of the inclined plane 34 on which the outlets of the second- and third-row air holes 32*b* are arranged. Therefore, the combustion gas is not supplied to the outlets of the second- and third-row air holes 32*b*, so that flame is not held in the vicinity of the outlets. Thus, conical flame 42 can be formed, which can similarly reduce the discharge amount of NOx.

The combustor 2 of the present embodiment described above includes the air hole plate 31, the first fuel nozzles 25*a* and the second fuel nozzles 25*b*. The air hole plate 31 is located on the upstream side of the combustion chamber 5 and has the first holes 32*a* and the second air holes 32*b* installed on the outer circumferential side of the first air holes. The first fuel nozzles 25 are adapted to supply gaseous fuel to the air holes 32*a*. The second fuel nozzles 25*b* are adapted to supply gaseous fuel to the air holes 32*b*. The above combustor is operated to jet the mixed gas of fuel and air from the air holes 32 to the combustion chamber 5, such operation may be likely to cause combustion oscillation due to the variation of the flame surface as described above. However, the combustor 2 of the present embodiment further has the orifices 24*b* adapted to allow the gaseous fuel supplied to the air holes 32*b* to cause a pressure drop. The orifice 24*b* causes the pressure drop through the fuel nozzle 25*b*, which ensures the differential pressure in the front and rear of the fuel nozzle 25*b*. This can suppress the combustion oscillation resulting from the variation of the flame surface.

The present embodiment has both the first orifices 24*a* adapted to allow the gaseous fuel supplied to the air holes 32*a* to cause a pressure drop and the second orifices 24*b* adapted to allow the gaseous fuel supplied to the air holes 32*b* to cause a pressure drop. The opening area of the second orifice 24*b* is smaller than that of the first orifice 24*a*. Thus, the combustor 2 has a suitable configuration for enhancing a suppressing effect of the combustion oscillation on the air hole 32*b* side where the combustion oscillation are likely to occur.

The fuel system in the present embodiment is divided into the fuel system 61 adapted to supply fuel to the first fuel nozzles 25*a* and the fuel system 62 adapted to supply fuel to the second fuel nozzles 25*b*. Thus, fuel can appropriately be supplied to each fuel nozzle and the differential pressure between the front and rear of each fuel nozzle can appropriately be controlled.

The present embodiment has flame-holding means for promoting flame-holding in the area of the air hole plate 31 where the first air holes 32*a* are installed. Specifically, the air hole plate 31 has the inclined plane 34, which protrudes toward the downstream side gradually as going to the radial inside. In addition, the combustion chamber side outlets of the second air holes 32*b* are provided on the inclined planes 34. In this way, the flow 43 moving toward the burner center and the recirculation flow 41 can be caused, it can provide the high-performance combustor that is stable with less discharge amount of NOx. In the present embodiment, as another flame-holding means, all the central axes of the air holes 32 are arranged inclinedly with respect to the burner central axis 50. In this way, the swirl flow 40 can be formed and thereby the recirculation flow 41 can be generated, which can further enhance the stability of flame. The flow 43 moving toward the burner center further serves as means for suppressing adhesion of flame in the area of the air hole plate 31 where the second air holes 32*b* are installed.

Second Embodiment

Figure 12:
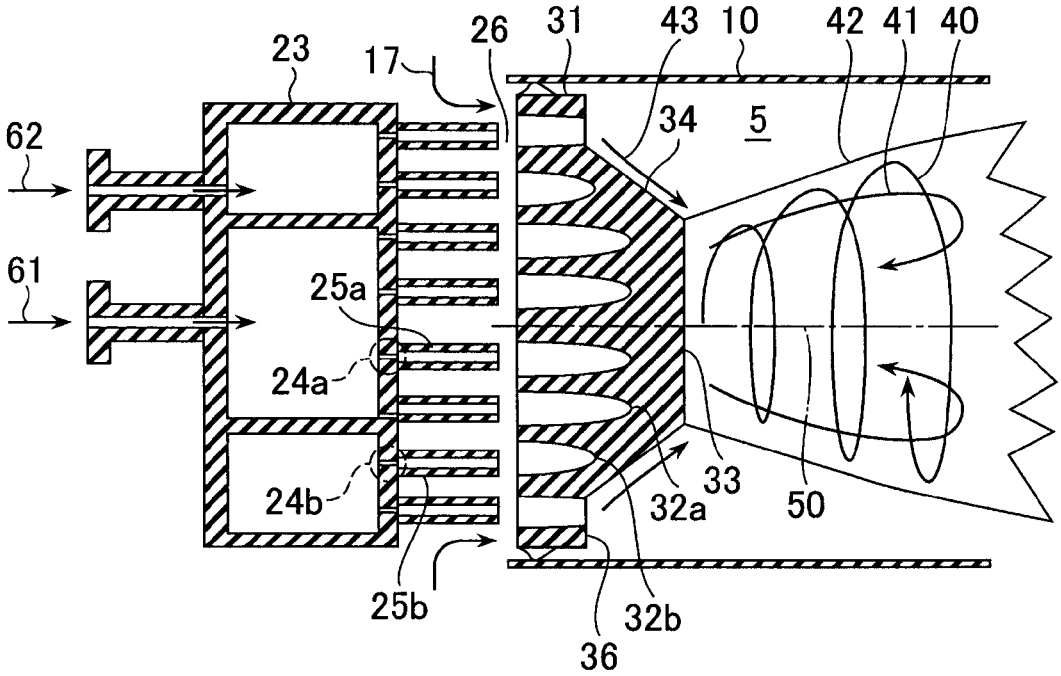
FIG. 12 is a partial configurational view illustrating the details of an arrangement state of a fuel nozzle header and fuel nozzles constituting a fuel supply section and an air hole plate in a gas turbine combustor according to a second embodiment.
Figure 13:
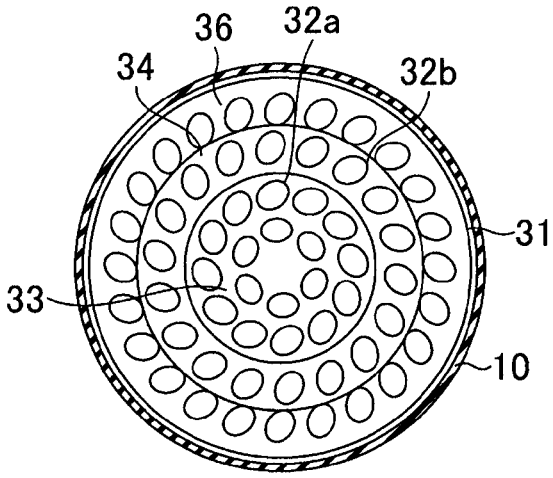
FIG. 13 is a front view of the air hole plate of the second embodiment shown in FIG. 12 as viewed from the combustion chamber side.

FIG. 12 is a cross-sectional view illustrating a second embodiment. FIG. 13 is a front view of a burner as viewed from a combustion chamber side. Unlike the first embodiment, the second embodiment is such that fuel nozzles 25*a* to which fuel is supplied from a fuel system 61 are arranged on two rows of concentric circles. Two-row air holes 32*a* are arranged to correspond to the fuel nozzles 25*a*. In addition, the two-row air holes 32*a* have respective outlets arranged on a flat surface 33 located at a leading end of a conically shaped air hole plate 31 extending toward a combustion chamber 5. Air holes 32 from a first row to a fourth row have respective central axes each inclined with respect to a burner central axis 50. Thus, a swirl flow 40 is formed on downstream side of the burner, thereby a large recirculation flow 41 is formed. This recirculation flow 41 returns high-temperature combustion gas from flame 42 to the upstream side. The high-temperature combustion gas supplies heat to the outlets of first-row air holes 32*a*, thereby stably holding flame at the outlets of the first-row air holes 32*a*. The combustion gas passes through a gap between pre-mixture jets jetted from the first-row air holes 32*a* and supplies heat to the vicinity of the second-row air hole outlets, thereby stably holding flame also at the outlets of second-row air holes 32*a*. Since the recirculation flow 41 is formed at a position where a part of the air hole plate 31 projects into the combustion chamber 5, entrainment resulting from the recirculation flow 41 causes a flow 43 moving toward the recirculation flow 41 in the vicinity of an inclined plane 34 of the air hole plate 31. This flow 43 prevents the high-temperature combustion gas at a central portion from flowing out toward third- and fourth-row air holes 32*b*. This prevents heat from being supplied to the vicinities of the outlets of the third- and fourth-row air holes 32*b*. Accordingly, flame is not held at the outlets of the air holes 32*b*. In addition, the outlets of the fourth-row air holes 32*b* are distant from flame 42 and the flow 43 moving toward the recirculation flow 41 acts not to supply high-temperature combustion gas to the outlets of the fourth-row air hole air holes 32*b*. Therefore, as in the present embodiment, the outlets of the fourth-row air holes 32*b* may be arranged in a flat portion 36 located at the outer circumferential portion of the air hole plate 31.

In the present embodiment, flame is held at the outlets of the first- and second-row air holes 32*a* similarly to the first embodiment. On the other hand, flame is not held at the outlets of the third- and fourth-row air holes 32*b*. In this way, the conical flame 42 is formed, which can suppress the discharge amount of NOx. Each fuel nozzle 25*b* corresponding to each of the air holes 32*b* can provide a sufficiently large pressure difference between the front and rear of the fuel nozzle through an orifice 24*b*. This orifice 24*b* is adapted to abruptly narrow and then abruptly expand a flow path through which fuel passes, thereby causing a pressure drop. Even if the flame surface of the conical flame 42 varies, the variation in fuel flow rate can be suppressed to a low level. Accordingly, the occurrence of combustion oscillation can be suppressed.

An orifice 24*a* installed in each of the fuel nozzles 25*a* not influenced by the variation of the flame surface is greater in diameter than that of the orifice 24*b*. The differential pressure between the front and rear of the fuel nozzle is suppressed to a low level, thereby a large amount of fuel can be allowed to flow. A large amount of fuel is supplied only to the first- and second-row fuel nozzles 25*a* under a part-load condition to form a fuel rich area, which makes it possible to form diffusion flame. A total amount of fuel supplied to the burner is small under the part-load condition, so that average temperature inside the combustion chamber 5 is low. Therefore, flame is unstable and unburned fuel is likely to occur. However, in the present embodiment, the diffusion flame is formed to provide stable flame, thereby making it possible to suppress the occurrence of unburned fuel. As described above, a balance can be achieved between a reduction in the discharge amount of NOx, and the suppression of combustion oscillation and the suppression of generation of unburned fuel under the part-load condition.

The present embodiment has the increased number of rows compared with that of the first embodiment, thereby enlarging the entire burner. Therefore, the present invention is suitable for a gas turbine generating more electricity. In addition, the area holding flame is wide; therefore, the stability of flame can be reinforced.

Third Embodiment

Figure 14:
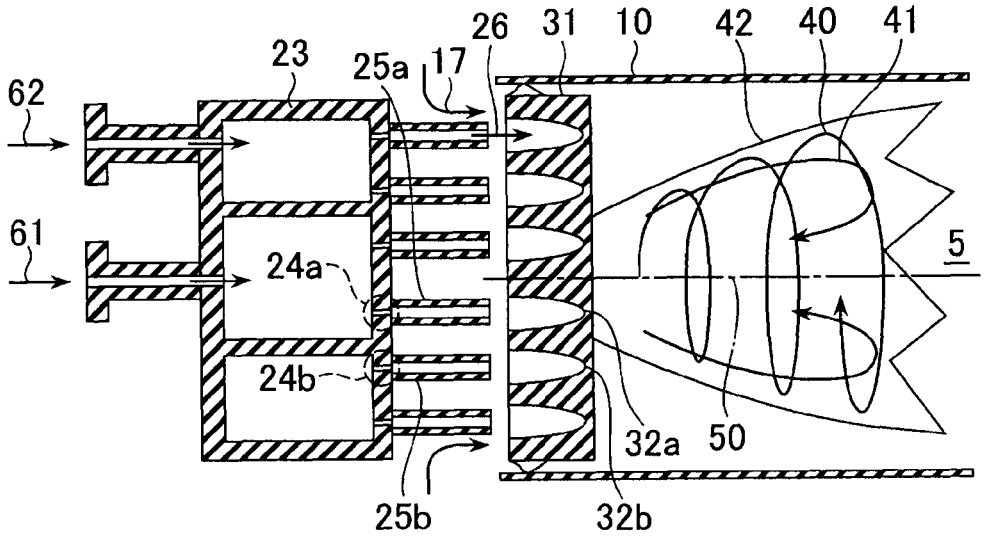
FIG. 14 is a partial structural view illustrating the details of an arrangement state of a fuel nozzle header and fuel nozzles constituting a fuel supply section and an air hole plate in a gas turbine combustor according to a third embodiment.
Figure 15:
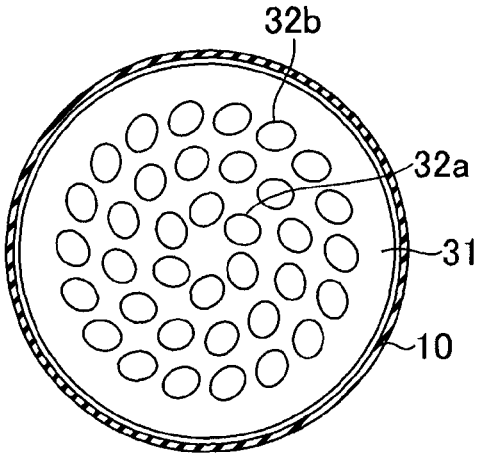
FIG. 15 is a front view of the air hole plate of the third embodiment shown in FIG. 14 as viewed from the combustion chamber side.

FIG. 14 is a cross-sectional view illustrating a third embodiment. FIG. 15 is a front view of FIG. 14. The third embodiment has almost the same configuration as that of the first embodiment. However, unlike the first embodiment, an air hole plate 31 has a flat-shaped surface facing a combustion chamber 5. In the first embodiment, the outlets of the second- and third-row air holes 32*b* are arranged in the inclined plane, thereby preventing the flame 42 from adhering to the air hole outlets. In the present embodiment, on the other hand, a downstream side central axis 52 shown in FIG. 4 is inclined so that a distance between the downstream side central axis 52 and a burner central axis 50 on a plane vertical to the burner central axis 50 is gradually reduced as going toward the downstream side from the air hole outlets. This prevents flame from adhering to second- and third-row air holes 32*b*.

Figure 16:
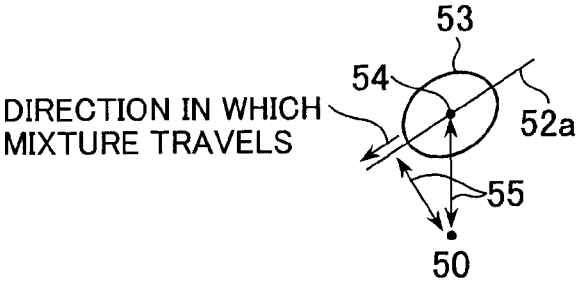
FIG. 16 illustrates a positional relationship between an air hole outlet and air hole central axis, and a burner central axis according to the third embodiment.

Details of the third embodiment are described with reference to FIGS. 16 to 18. FIG. 16 is a front view illustrating one of first-row air holes 32*a* of the present embodiment as viewed from the combustion chamber 5. In the present embodiment, an air hole central axis 52*a* projected onto a plane vertical to the burner central axis 50 is configured to reduce a distance 55 between the burner central axis 50 and the air hole central axis 52*a* as going toward the downstream side from a first-row air hole outlet center 54.

Figure 17:
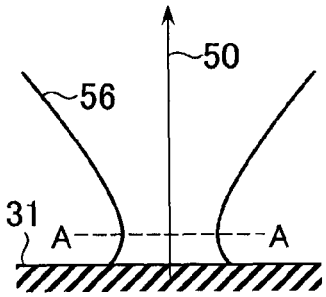
FIG. 17 illustrates a streamline of a mixture projected onto a second-dimensional flat surface, the mixture being jetted from first-row air holes of the third embodiment.

FIG. 17 shows a line 56 resulting from projecting, onto a two-dimensional surface, a stream line drawn by the mixture jetted from the first-row air hole 32*a*. As shown in the figure, with the configuration of the present embodiment, the mixture jetted from the air hole once comes close to the burner central axis 50 and then spreads toward the outer circumferential side.

Figure 18:
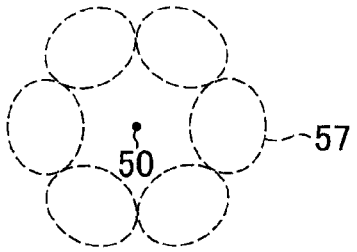
FIG. 18 illustrates the positional relationship among mixture jets in cross-section A-A of the FIG. 17.

FIG. 18 is a cross-sectional view taken along line A-A in FIG. 17. In cross-section A-A, a mixture jet 57 jetted from each of the first-row air holes 32*a* is in contact with mixture jets adjacent thereto. The high-temperature combustion gas returned by the recirculation flow 41 is confined inside the first-row mixture jets 57. Sufficient heat is not transmitted to the vicinity of the outlets of the second- and third-row air holes 32*b*. Thus, it is possible to prevent flame adhering to the air hole outlets.

As described above, similarly to the first embodiment, the present embodiment can prevent flame from adhering to the outlets of the second- and third-row air holes 32*b*. In addition, the conical flame 42 as shown in FIG. 14 can be formed. With this, fuel can be burned in a state where fuel and air are well-mixed, so that the discharge amount of NOx can be reduced. Further, an orifice 24*b* having a small diameter is installed in each fuel nozzle 25*b* corresponding to each of the second- and third-row air holes 32*b* in which flame is not held at each of the air hole outlets. This suppresses the variation of the fuel flow rate resulting from the flame variation, which suppresses the occurrence of combustion oscillation. Thus, a balance can be achieved between the reduced discharge amount of NOx and the suppression of combustion oscillation. An orifice 24*a* is installed in each first-row fuel nozzle

25*a* corresponding to each of the air holes 32*a* holding flame at its outlet. The flame surface downstream of this orifice 24*a* does not vary, hence, there is no concern of the variation in fuel flow rate. The orifice 24*a* has a larger diameter than that of each of the second- and third orifices 24*b*. Accordingly, the orifice 24*a* allows fuel to flow at a greater flow rate. Similarly to the first embodiment, fuel is supplied only to the fuel nozzles 25*a* under a part-load condition, so that rich fuel can be supplied into the combustion chamber 5, thereby forming diffusion flame. Thus, even if a flow rate of fuel supplied to the combustor 2 is low, stable flame can be formed, which can suppress the occurrence of unburned fuel.

Fourth Embodiment

Figure 19:
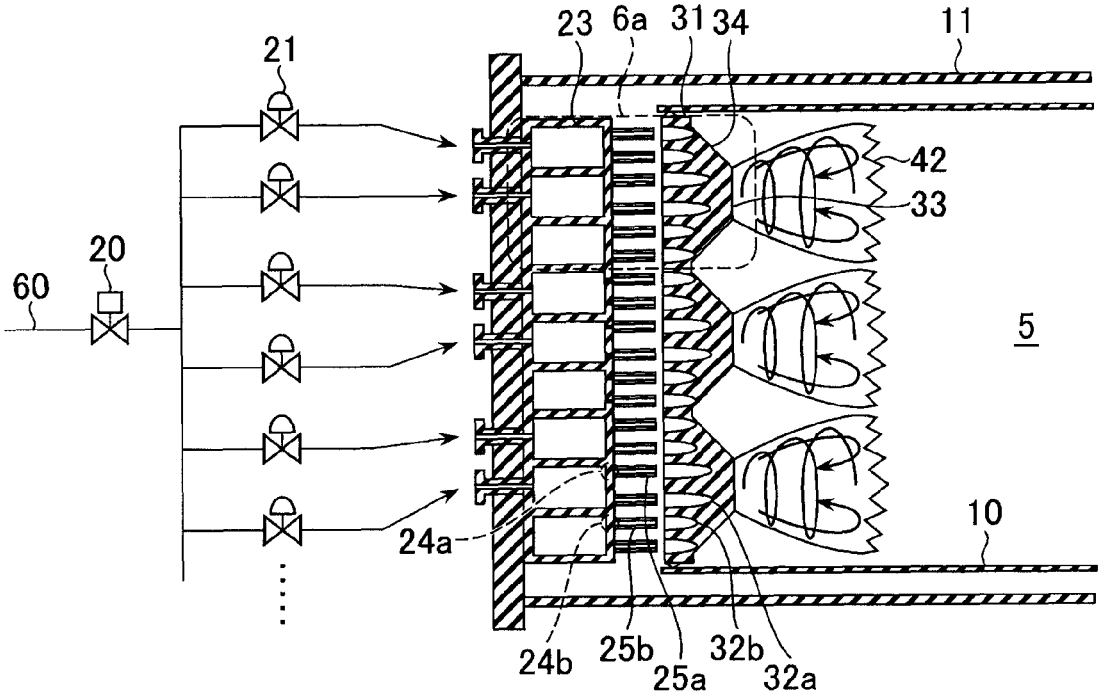
FIG. 19 is a partial structural view illustrating the details of an arrangement state of a fuel nozzle header and fuel nozzles constituting a fuel supply section and an air hole plate in a gas turbine combustor according to a fourth embodiment.
Figure 20:
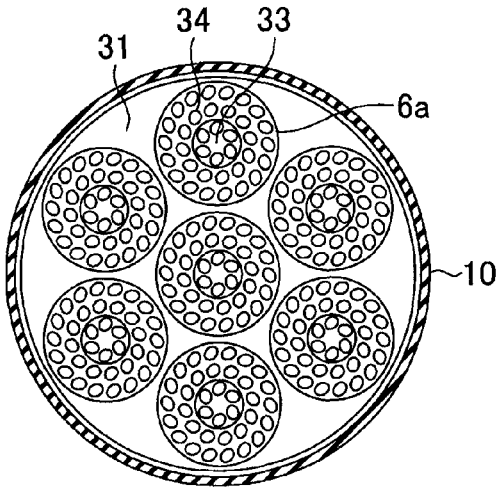
FIG. 20 is a front view of the air hole plate of the fourth embodiment shown in FIG. 19 as viewed from the combustion chamber side.

FIG. 19 is a cross-sectional view of a fourth embodiment. FIG. 20 is a front view of an air hole plate 31 as viewed from a combustion chamber 5. In the fourth embodiment, a single burner is configured by combining seven burners 6*a* each having the same configuration as that of the first embodiment. This burner is effective for a gas turbine generating large amount of electricity. The burner 6*a* has a center projecting toward a combustion chamber 5. First-row air holes 32*a* have outlets arranged on a flat surface 33 located at the leading end of the burner. Second- and third-row air holes 32*b* have outlets located on an inclined plane 34 inclined with respect to the burner central axis. Fuel nozzles 25*a* are paired with air holes 32*a* whereas fuel nozzles 25*b* are paired with air holes 32*b*. Orifices 24*a* each installed in a corresponding one of the fuel nozzles 25*a* is smaller in diameter smaller than that of each of orifices 24*b* installed in a corresponding one of the fuel nozzles 25*b*.

In the present embodiment, similarly to the first embodiment, flame is held at the outlets of the first-row air holes 32*a* of each burner 6*a*. Meanwhile, flame is not held at the outlets of the second- and third-row air holes 32*b*, so that conical flame 42 is formed. Thus, a discharge amount of NOx can be suppressed to a low level. The orifice 24*b* installed in the fuel nozzle 25*b* corresponding to the air hole 32*b* can provide sufficiently large differential pressure between the front and rear of the fuel nozzle. Even if the flame surface of the conical flame 42 is varied, a variation in fuel flow rate can be suppressed to a low level, which can suppress the occurrence of combustion oscillation. The orifice 24*a* installed in the fuel nozzle 25*a* not influenced by the variation of the flame surface is greater in diameter than that of the orifice 24*b*. This suppresses the differential pressure between the front and rear of the fuel nozzle to a low level. Thus, the orifice 24*a* allows a large amount of fuel to flow. The large amount of fuel is supplied only to the first-row fuel nozzles 25*a* to form the fuel rich area, thereby forming diffusion flame. The total amount of the fuel supplied to the burner is small under a part-load condition. Since the average temperature inside the combustion chamber 5 is low, flame becomes unstable and unburned fuel is likely to occur. However, the present embodiment can form stable flame by forming the diffusion flame, thereby suppressing the occurrence of unburned fuel. As described above, a balance can be achieved between the reduced discharge amount of NOx, and the suppression of combustion oscillation and the suppression of the generation of unburned fuel under a part-load condition.

The first embodiment has the separate fuel systems supplying fuel to the first-row fuel nozzles 25*a* and the second- and third-row fuel nozzles 25*b*. In the present embodiment, similarly to the first embodiment, a fuel supply system is divided into a fuel supply system adapted to supply fuel to the first-row fuel nozzles 25*a* of each of the burners 6*a* and a fuel supply system adapted to supply fuel to the second- and third-row fuel nozzles 25*b*. The fuel supply system adapted to supply fuel to the first-row fuel nozzle 25*a* and the fuel supply system adapted to supply fuel to the second- and third-row fuel nozzles 25*b* are divided for each burner 6*a*. Thus, the fuel supply system can flexibly be operated according to operating conditions. However, since the number of the fuel systems is increased to increase the cost of the entire plant, a single fuel system may be made to supply fuel to the first-row fuel nozzles 25*a* of a plurality of the burners 6*a*. Similarly, a single fuel system may be made to supply fuel to the second- and third-row fuel nozzles 25*b* of a plurality of the burners 6*a*.

Figure 21:
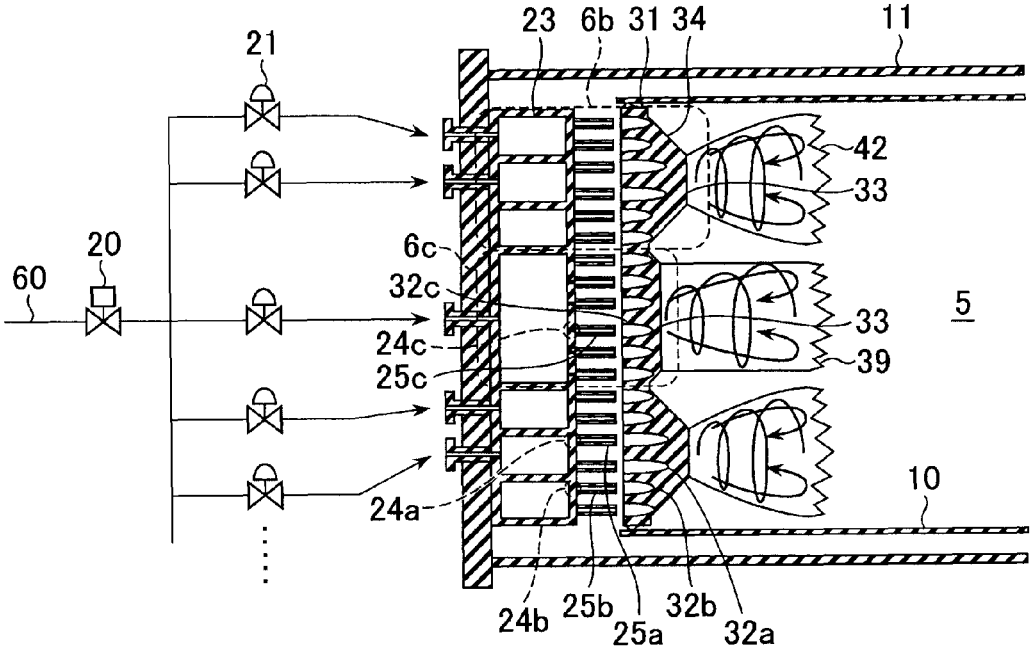
FIG. 21 is a partial structural view illustrating the details of an arrangement state of a fuel nozzle header and fuel nozzles constituting a fuel supply section and an air hole plate in a gas turbine combustor according to a variation of the fourth embodiment.

A variation of the fourth embodiment is shown in FIG. 21. In this variation, a central burner 6*c* of seven burners is such that all the outlets of three-row air holes 32*c* are arranged on a flat surface 33. Flame 39 is held at all the outlets of the air holes 32*c*. Three-row Fuel nozzles 25*c* are paired with the air holes 32*c*. An orifice 24*c* attached to each fuel nozzle 25*c* of the central burner 6*c* is greater in diameter than that of an orifice 24*b* installed in each of the second- and third-row fuel nozzles 25*b* of external burners 6*b*.

The central burner 6*c* holds the flame 39 at all the outlets of the air holes 32*c*; therefore, the flame 39 is highly stabilized. In addition, the central burner 6*c* can assist the holding of conical flame 42 formed by the external burners 6*b*. The flame 39 has a flame surface hard to be varied; therefore, even if the diameter of the orifice 24*c* is increased, there is no concern about combustion oscillation. Fuel is supplied only to the central burner 6*c* under a part-load condition, which can bring a fuel rich state at the air hole outlets, thereby forming diffusion flame. Accordingly, combustion stability can be formed, which can suppress the occurrence of unburned fuel.

The combustor of the present variation described above includes the plurality of first burners 6*b* each having the first air holes 32*a*, the first fuel nozzles 25*a*, the second air holes 32*b* and the second fuel nozzles 25*b*; and the second burner 6*c* having the third air nozzles 32*c*, the third fuel nozzles 25*c* adapted to supply gaseous fuel to the third air holes 32*c*, and disposed to be surrounded by the plurality of first burners 6*b*. In addition, the combustor includes the first orifices 24*a* each adapted to allow the gaseous fuel supplied to the first air hole 32*a* to cause a pressure drop; the second orifices 24*b* each adapted to allow the gaseous fuel supplied to the second air hole 32*b* to cause a pressure drop; and the third orifices 24*c* each adapted to allow the gaseous fuel supplied to the third air hole 32*c* to cause a pressure drop. The second orifice 24*b* has the opening area smaller than that of each of the first orifice 24*a* and the third orifice 24*c*. With this configuration, even the multi-burner combining the plurality of burners can achieve a balance between the reduction in the discharged amount of NOx, and the ensuring of combustion stability and the suppression of the occurrence of combustion oscillation.

What is claimed is:

1. A gas turbine combustor comprising:

a combustion chamber to which fuel and air are supplied;

an air hole plate located on an upstream side of the combustion chamber and having a first air hole adapted to supply air to the combustion chamber, and second air holes installed on an outer circumferential side of the first air hole and adapted to supply air to the combustion chamber;

a first fuel nozzle adapted to supply gaseous fuel to the first air hole;

second fuel nozzles adapted to supply gaseous fuel to the second air holes;

a first orifice adapted to allow the gaseous fuel supplied to the first air hole to cause a pressure drop; and a second orifice adapted to allow the gaseous fuel supplied to each of the second air holes to cause a pressure drop;

wherein the second orifice has an opening area smaller than an opening area of the first orifice.

2. The gas turbine combustor according to claim 1, wherein a fuel system adapted to supply fuel to the first fuel nozzle and a fuel system adapted to supply fuel to the second fuel nozzles are respective separate systems.

3. The gas turbine combustor according to claim 1, further comprising:

an inclined plane of the air hole plate projecting toward a downstream side gradually going toward a radial inside, the combustion chamber side outlets of the second air holes being installed on the inclined plane.

4. The gas turbine combustor according to claim 1, wherein central axes of the air holes incline with respect to a central axis of the air hole plate.

5. The gas turbine combustor according to claim 1, further comprising:

a plurality of first burners each having the first air hole, the first fuel nozzle, the first orifice, the second air holes, the second fuel nozzles, and the second orifice; and a second burner disposed to be surrounded by the plurality of first burners;

wherein the second burner includes a third air hole adapted to supply air to the combustion chamber, a third fuel nozzle adapted to supply gaseous fuel to the third air hole, and a third orifice adapted to allow gaseous fuel supplied to the third air hole to cause a pressure drop; and wherein the second orifice has an opening area smaller than an opening area of the first orifice and than that of the third orifice.

6. The gas turbine combustor according to claim 5, wherein the each of the first, second, and third orifices gives an abruptly narrowing portion and an abruptly expanding portion to the fuel nozzle.

* * * * *